US005362024A

United States Patent [19]

Grinnen

[11] Patent Number: 5,362,024

[45] Date of Patent: Nov. 8, 1994

[54] CHRISTMAS TREE STAND

[76] Inventor: James R. Grinnen, R.D. #2 Box 2470A, Wampum, Pa. 16157

[21] Appl. No.: 99,913

[22] Filed: Jul. 30, 1993

[51] Int. Cl.[5] ..... F16M 13/00

[52] U.S. Cl. ..... 248/524; 47/40.5; 248/523

[58] Field of Search ..... 248/514, 519, 520, 523, 248/524, 346; 47/40.5, 42

[56] References Cited

U.S. PATENT DOCUMENTS

| | | | |
|---|---|---|---|
| 893,247 | 7/1908 | Killerbrue | 248/523 |
| 1,794,107 | 2/1931 | Doyle | 248/524 |
| 2,455,404 | 12/1948 | Brown | 47/40.5 |
| 2,459,533 | 1/1949 | Irvin | 248/524 X |
| 2,502,040 | 3/1950 | Franklin | 248/524 X |
| 2,671,624 | 3/1954 | Carney | 248/524 |
| 2,703,213 | 3/1955 | Zamierowski | 47/40.5 X |
| 3,119,585 | 1/1964 | Austenson | 47/40.5 |
| 4,381,621 | 5/1983 | Eby | 47/40.5 |
| 4,901,971 | 2/1990 | Connelly | 248/523 |

FOREIGN PATENT DOCUMENTS

| | | | |
|---|---|---|---|
| 476208 | 8/1951 | Canada | 248/523 |

*Primary Examiner*—J. Franklin Foss
*Attorney, Agent, or Firm*—James L. Sherman

[57] ABSTRACT

A tree stand accommodates a range of tree trunk diameters. The stand includes four legs mounted to an L-shaped member. A tree holder also is mounted to the L-shaped member, and can be adjusted to accommodate trunks of different diameters. The stand can be mounted to a tree that has been laid on its side, and the stand and the tree can be righted as a unit.

19 Claims, 7 Drawing Sheets

CHRISTMAS TREE STAND

BACKGROUND OF THE INVENTION

The present invention relates to stands and, more particularly, to an adjustable tree stand that can position a cut tree in an upright position.

There are many occasions when it is desired to cut a tree and display it in, generally, an upright position. One of the most readily recognized occasions is the Christmas season, at which time cut evergreen trees are displayed both indoors and outdoors.

Tree stands, and particularly "Christmas tree" stands, are quite well known. One very common type of tree stand includes four legs, a watering pan or dish that also serves as a base or support for the tree and that bears the weight of the tree, four (usually) mounting bolts, and a ring that both connects and stabilizes the legs and positions the mounting bolts. The upper ends of each leg extend through the pan above the waterline, and are joined together by the ring. The legs extend below and outboard of the pan where their ends engage the supporting surface to support the stand on the surface. The ring also surrounds the tree trunk, which rests on the bottom of the pan. The four bolts are threaded into the side of the trunk through holes formed in the ring equidistantly around the circumference of the ring. The ring, the bolts, and the pan cooperate to secure the stand to the tree trunk.

Unfortunately, this type of stand has well-known drawbacks. The stand lacks stability for larger trees due to the relatively small size of the legs. Mounting the tree to the stand is difficult, since the tree must be first lifted and then lowered until the trunk passes through the ring and engages the bottom of the pan, the bolts must be tightened until they all engage the trunk, and the degree to which the bolts are threaded into the trunk must be adjusted until the tree is "straight." This is a difficult two person procedure, especially for a larger tree. The alternative is to mount the stand to the tree while the tree is lying on its side. This is also a difficult procedure, due to the need to tighten the four bolts against the tree trunk while the tree is on its side, and to right the tree after the tree is mounted without damaging the stand. Nonetheless, after the tree is righted, it still must be straightened. With either mounting method, the pan may be cracked or otherwise damaged by the pressure exerted against it by the trunk both during the mounting process and while the tree is being displayed, which will cause the liquid nutrient to leak from the pan. The location of the pan itself (which is fixed since the pan also must function as the primary support for the tree) makes it difficult to "water" the tree. Generally, it is necessary to maneuver a watering can, or some other vessel, full of water, under the branches of the tree to a point near the trunk, and pour the nutrient into the pan. Finally, the diameter of the ring itself imposes a limitation on the size of a trunk that can be accommodated by the stand.

There exists, therefore, a need for a stable, adjustable tree stand to which a cut tree can be mounted more easily, and that permits the tree to be watered with little difficulty.

SUMMARY OF THE INVENTION

The present invention provides a tree stand that includes a base for supporting the stand on a supporting surface and a tree holder for holding a tree by its trunk.

The holder includes apparatus to adapt the holder to trees with trunks of different sizes.

The preferred embodiment of the present invention includes a base with four legs, each of which includes an adjuster pad or leveller that engages a supporting surface, and that permits adjustment of the inclination of a tree held by the tree holder. The holder of the preferred embodiment includes a ratchet and belt assembly, known in the trade as a "ratchet tie down," that encircles the tree trunk and that can be adjusted to adapt the holder to trees with different size trunks. The ratchet is used to tighten the belt around the tree trunk.

An alternate embodiment of the invention includes a vertical support for bearing the weight of the tree and supporting the tree vertically, and a lateral support that includes two members between which the tree trunk is held to restrict lateral movement of the tree trunk and inhibit the tree from toppling, the positions of the members being adjustable relative to each other to accommodate tree trunks of different thicknesses. Preferably, the members combine to surround the tree trunk completely. Most preferably, one of the lateral support members is a U-bolt.

BRIEF DESCRIPTION OF THE DRAWING

The following detailed description of the preferred embodiment may be understood better if reference is made to the appended drawing, in which.

DETAILED DESCRIPTION OF THE PREFERRED EMBODIMENT

Figure 1:
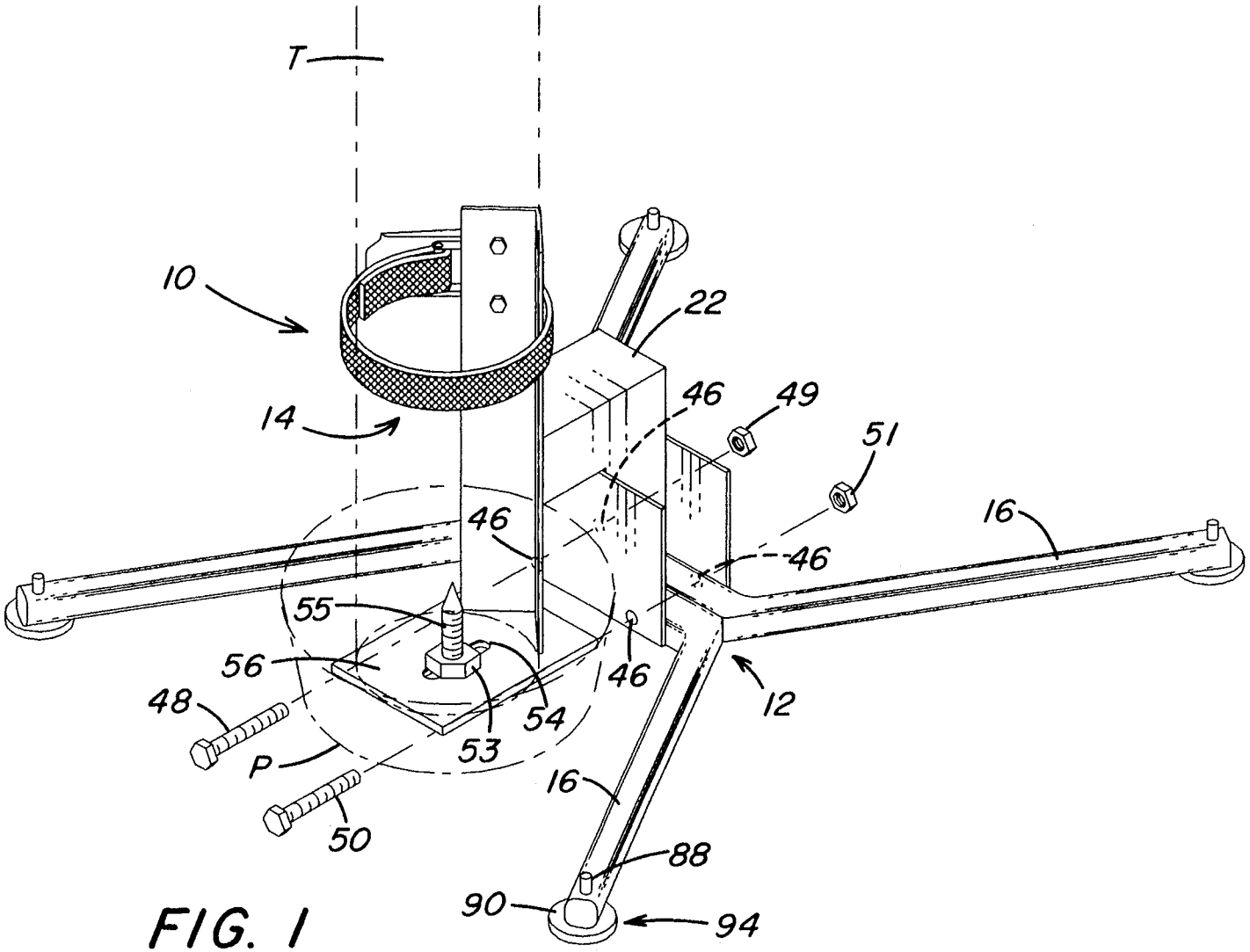
FIG. 1 is an exploded view of the tree stand that constitutes the preferred embodiment of the present invention, with a tree trunk and watering pan shown in phantom.
Figure 4:
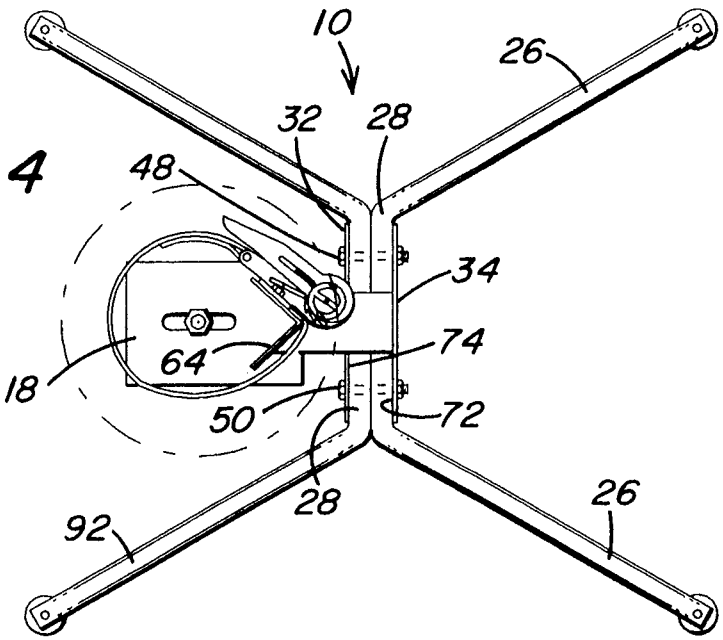
FIG. 4 is a top plan view of the tree stand shown in FIG. 1.
Figure 2:
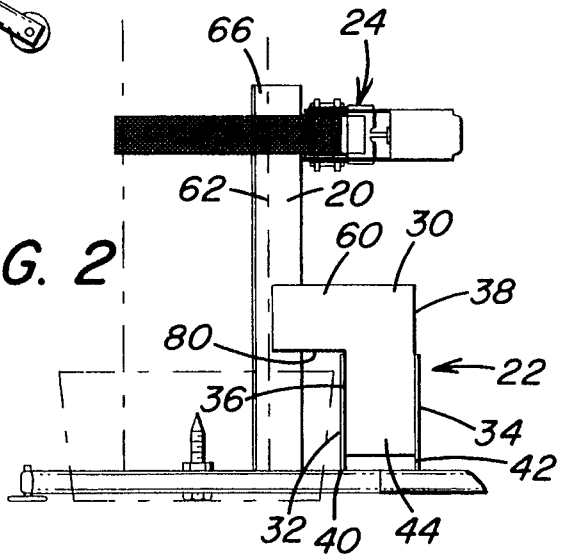
FIG. 2 is a side view of the tree stand shown in FIG. 1.
Figure 3:
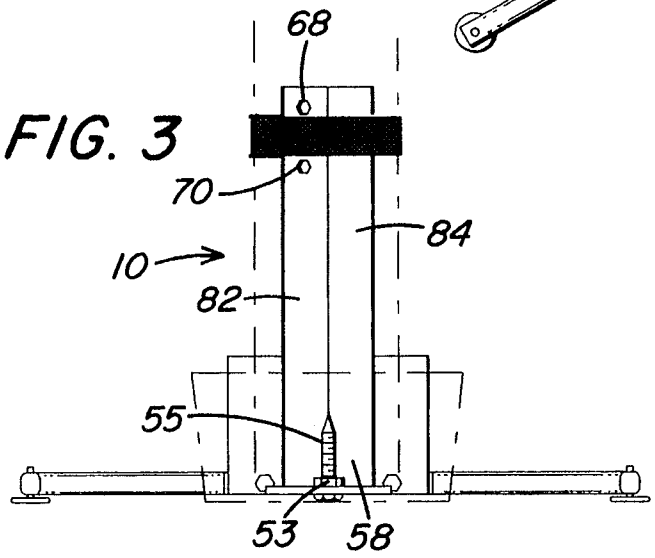
FIG. 3 is a front view of the stand shown in FIG. 1.

FIGS. 1 through 4 show tree stand 10, which is the preferred embodiment of the present invention. Generally, stand 10 includes a base 12 that supports stand 10 on a supporting surface (for example, a floor), and a holder 14 that is used to hold and position a tree by its trunk T. Base 12 is formed from two leg units 16 and a base unit 22, to which leg units 16 are secured. Holder 14 is formed from vertical support 18, which bears the weight of the tree, ratchet and belt assembly 24 and a stabilizer angle 20, to which assembly 24 is secured. Ratchet and belt assembly 24 cooperate with angle 20 to accommodate, and stabilize, trees with trunk diameters ranging from about two inches to eight inches.

Figure 5:
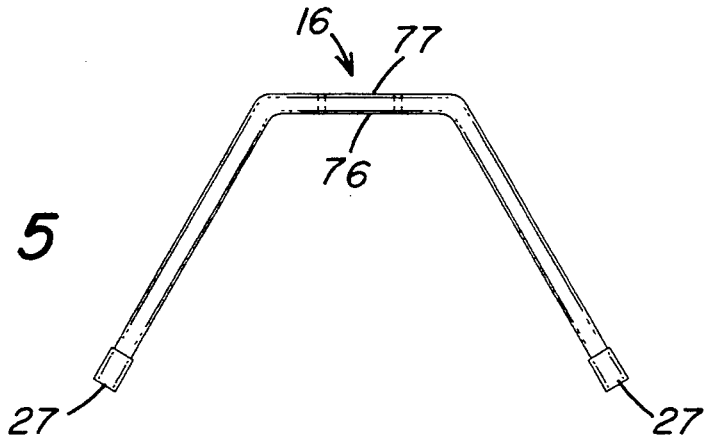
FIG. 5 is a top view of one of the basic leg units for the stands shown in FIGS. 1 and 8.
Figure 6:
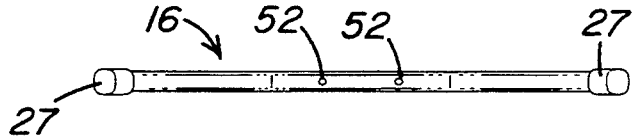
FIG. 6 is a front view of the leg unit shown in FIG. 5.
Figure 7:
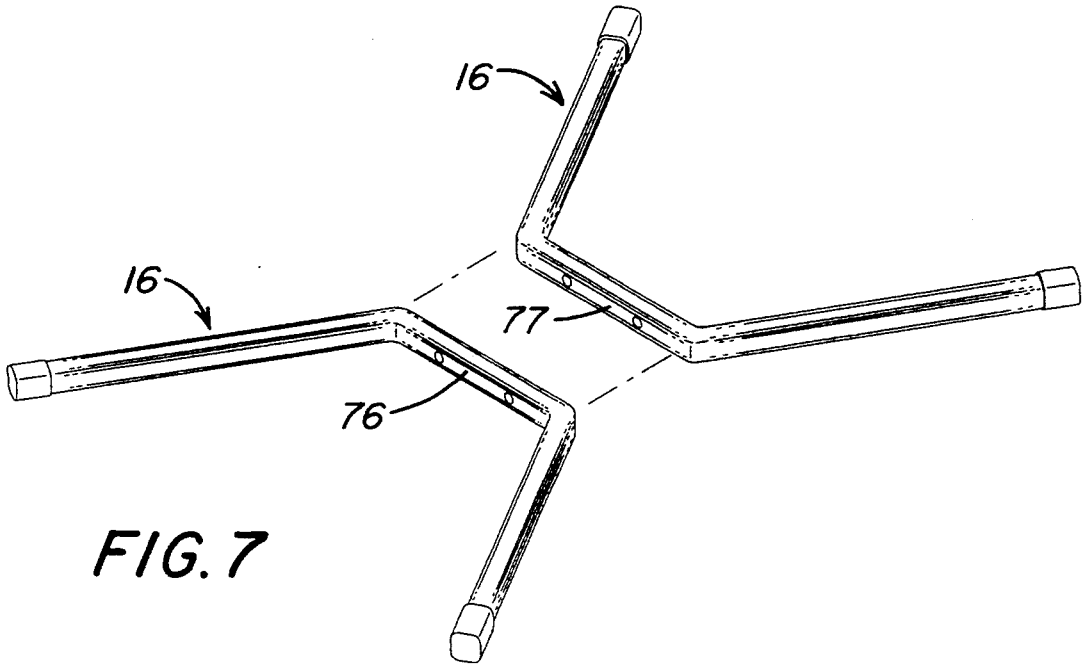
FIG. 7 is an isometric view of both leg units shown in FIG. 5, shown generally in position for mounting.

Leg units 16 and base unit 22 form base 12. Each unit 16 is formed from a single piece of steel, and defines a pair of legs 26 and a mounting bar 28 that joins at its ends to one end of each of legs 26. The joint between each leg 26 and bar 28 is preferably curved, as is shown in FIG. 5. The angle formed by the longitudinal axes of each of leg 26 and bar 28 should be about 55°. A conventional adjuster pad, or leveller, 94 is mounted to end 92 of each leg 26 of leg units 16 through threaded holes formed in the end of each leg 26. Levellers 94 engage the supporting surface during use of stand 10. Each leveller 94 can be adjusted to raise or lower the end of the leg 26 to which it is mounted. Levellers 94 can, therefore, be adjusted to set within a range the inclination of a tree held by stand 10. Each leveller 94 includes a pad 90 and a threaded post or stud 88 that is suitably secured at one end to the upper surface of pad 90. The remaining end of stud 88 is threaded through a hole formed in end 92 of leg 26. The hole should be so sized that the vertical position of stud 88, and pad 90, with respect to end 92 can be adjusted with respect to end 92 by threading stud 88 further through or out of the hole, and that stud 88 will generally maintain that position. Rubber or plastic sleeves 27 of the type shown in FIGS. 5 through 8 can be slipped over ends 92 of legs 26 to protect both the ends of legs 26 and the user.

Several of the advantages provided by stand 10 are a consequence of leg units 16. The length of legs 26 of units 16 and the angles at which the longitudinal axes of legs 26 and bar 28 meet provide stability for trees of heights from about two feet to 12 feet. Those same features of units 16 also facilitate attachment of stand 10 to a tree trunk while the tree is lying on its side, and subsequent righting of the tree and stand 10 together.

Base unit 22 is formed by L-shaped member 30 and rectangular base plates 32 and 34. Plates 32 and 34 are secured to sides 36 and 38, respectively, of member 30 by any suitable process, like welding. Ends 40 and 42 of plates 32 and 34, respectively, extend below end 44 of member 30. Ends 40 and 42 engage the supporting surface during use of stand 10, and aid in supporting stand 10 on the supporting surface. A pair of holes 46 is formed in the lower corners of each of plates 32 and 34 to receive leg mounting bolts 48 and 50. Similarly, two mounting holes 52 are formed in each of mounting bars 28 of leg units 16 to receive bolts 48 and 50. The diameter of each hole 46 is matched to the diameter of each hole 52, and each pair of holes 46 is spaced to permit their alignment with holes 52. Bolts 48 and 50 can, therefore, be inserted through holes 46 and 52 to bolt plates 32 and 34 to bars 28.

Two leg units 16 are mounted to plates 32 and 34 by bolting their mounting bars 28 between plates 32 and 34. Surface 76 of bar 28 of a first unit 16 is placed in contact with surface 74 of plate 32, and holes 52 of unit 16 are aligned with holes 46 of plate 32. Surface 76 of the second unit 16 is placed into contact with surface 72 of plate 34, and holes 52 of unit 16 are aligned with holes 46 of plate 34. Bolts 48 and 50 are then inserted through holes 46 and 52 of plates 32 and 34, and units 16, respectively. Nuts 49 and 51 are threaded onto the ends of bolts 48 and 50, respectively, and tightened against plate 34 to secure legs 16 to base unit 22.

Stabilizer angle 20, ratchet tie down 24 and vertical plate 18 form holder 14. Stabilizer angle 20 is formed from a piece of conventional angle bar. Vertical support 18 is generally rectangular-shaped and defines a slot 54. End 58 of angle 20 is welded to upper surface 56 of support 18. A pointed or spiked bolt 55 is provided that, during use of stand 10, protrudes through slot 54 from beneath support 18. The pointed end of bolt 55 is driven into the end of the tree trunk, and prevents the trunk from sliding off support 18. A nut 53 is threaded onto bolt 55, and is located between the bottom of the tree trunk and surface 56 of support 18 when a tree is mounted to holder 14. Nut 53 should be tightened just enough to ensure that bolt 55 can slide within slot 54 without too much play. Slot 54, bolt 55 and nut 53 permit some movement of bolt 55 and, therefore, some adjustment of the position of the tree trunk on support 18. End 60 of member 30 defines a surface 64 that is contoured to match rear surface 62 of angle 20. End 60 of member 30 is welded to rear surface 62 of angle 20 at surface 64 at a location on surface 62 that results in a separation between vertical support 18 and the supporting surface of about one inch when stand 10 is placed on the surface. This separation ensures that there will be some separation between the undersurface of support 18 and the bottom of the pan when the pan is placed in use to water the tree.

Figure 15:
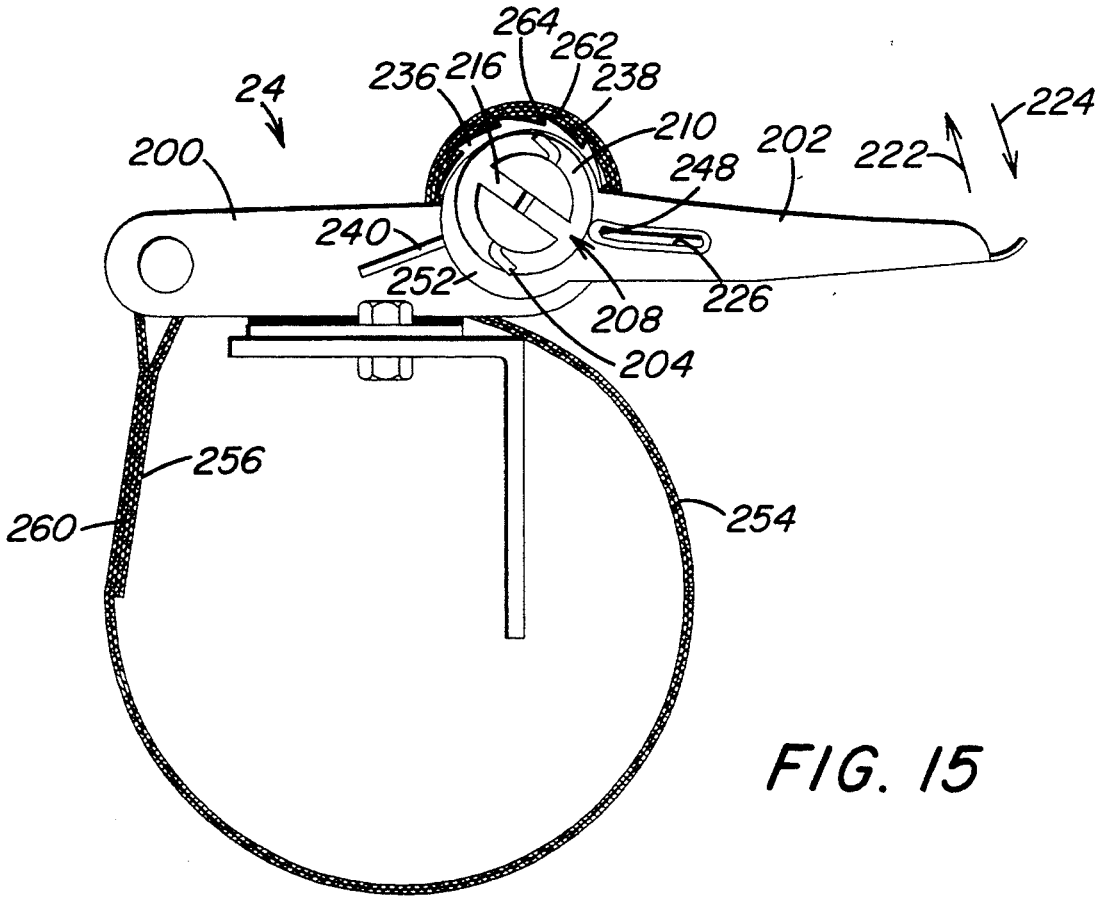
FIG. 15 is a side view of the ratchet tie down shown in FIG. 4.
Figure 16:
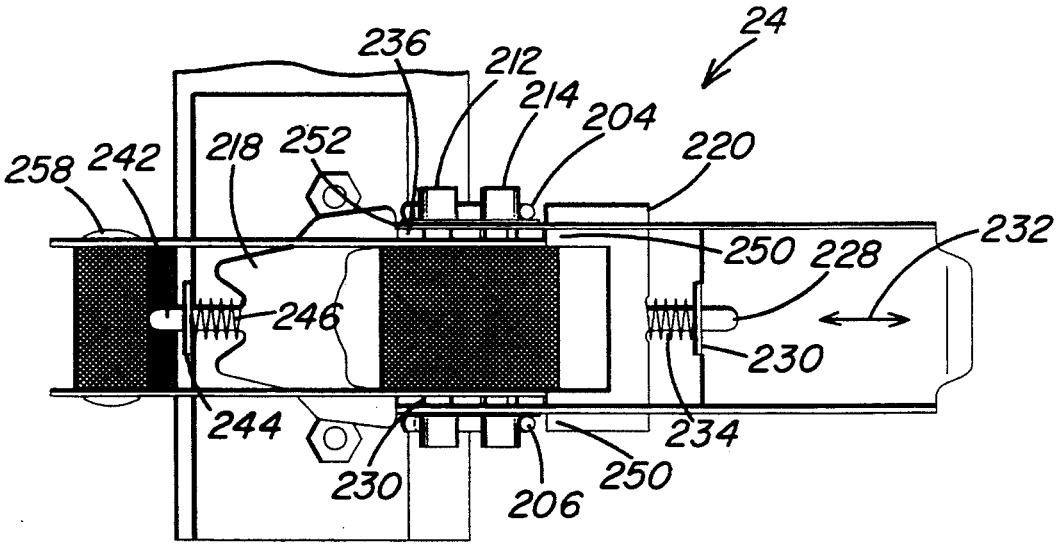
FIG. 16 is a bottom view of the ratchet tie down shown in FIG. 15.

FIGS. 15 and 16 show ratchet tie down 24 in greater detail. Ratchet tie down 24 is a standard component. Preferably, assembly 24 is a product marketed by Kinedyne Corporation, of New Jersey. The ratchet is identified by Kinedyne Corporation in their literature as a "1 [inch] Standard Handle Light Duty Ratchet," and the belt is described as "Part Number 1000" polyester webbing, one inch (25 millimeters) in width, with a breaking strength of 3,500 pounds (1,550 kilograms).

Generally, assembly 24 is symmetrical. Therefore, a view of the side opposite that shown in FIG. 15 would be the mirror image of FIG. 15. Assembly 24 includes a frame 200 and a handle 202. End 252 of handle 202 forms a cam. Cam 252 helps to control the positioning of pawl 218, as is described in more detail below. Two shafts 212 and 214 join frame 200 and handle 202 to each other. Shafts 212 and 214 have a cross section generally in the shape of a partial circle, which can be seen from FIG. 15. Shafts 212 and 214 are inserted through generally circular openings formed in the sides of frame 200 and 202. The opening formed in end 252 of handle 202 is located eccentrically to form the cam. Pins 204 and 206 are inserted through passages formed in each end of shafts 212 and 214. The ends of each pin 204 and 206 are bent in opposite directions, and secure shafts 212 and 214 to frame 200 and handle 202. A spacer plate 208 is located between each pin 204 and 206 and the side of handle 202. Each plate 208 defines a rim 210 and a cross bar 216. Bars 216 are located between the ends of shafts 212 and 214, and establish a spatial separation between those ends. The positions of shafts 212 and 214 are, therefore, fixed relative to each other, and they form a sort of split shaft, which can be rotated within the openings formed in frame 200 and handle 202. A ratchet wheel 236 is mounted on each end of the split shaft formed by shafts 212 and 214 between handle 202 and frame 200. Each of ratchet wheels 236 defines a pair of openings, each of which has a cross section that is matched in size and shape to the cross section of shafts 212 and 214. Rotation of wheels 236, therefore, causes corresponding rotation of shafts 212 and 214. Each wheel 236 defines a number of ratchet teeth 238, each tooth 238 defining a ramp section 262 and a stop section 264.

Assembly 24 includes a frame pawl 218 and a handle pawl 220. Pawl 220 is used to rotate shafts 212 and 214 in the direction shown by arrow 224 when handle 202 is in a ratcheting position. Pawl 218 prevents rotation of shafts 212 and 214 in the direction shown by arrow 222 when handle 202 is in a ratcheting position. The ends of pawl 220 extend through slots 226 formed in the sides of handle 202 (one slot 226 being shown in FIG. 15). Each slot 226 communicates with one of the generally circular openings formed in the side of handle 202 to facilitate the positioning of pawl 220 in the handle. Pawl 220 includes a mounting stem 228 that is inserted through an opening formed in a mounting flange 230 formed by handle 202. Slots 226 and flange 230 restrict movement of pawl 220 to the sliding movement indicated by double arrow 232. A spring 234 is disposed around stem 228 and biases pawl 220 toward ratchet wheels 236. Pawl 218 is mounted to frame 200 in slots 240 formed in the sides of frame 200. Slots 240 communicate with the openings formed in frame 200 to facilitate mounting of pawl 218 to frame 200. Pawl 218 includes a stem 242 that is inserted through an opening defined by flange 244 formed by frame 200. Slots 240 and flange 244 limit movement of pawl 218 to sliding movement in the directions indicated by arrow 232. A spring 246 is disposed around stem 242 and biases pawl 218 toward ratchet wheels 236.

Each side edge of frame 200 forms a notch 248 that is located to accept an edge of an end 250 of pawl 220. Both ends 250 of pawl 220 are located in a notch 248 when the handle 202 is in the open position shown in FIG. 15, in which position handle 202 cannot be rotated. When handle 202 is in the open position, cam 252 of handle 202 bears against the ends of pawl 218 and prevents them from engaging teeth 238 of wheels 236. Also when handle 202 is in the open position, ends 250 of pawl 220, because they are in notches 248, do not engage the teeth 238 of wheels 236. Therefore, when handle 202 is in the open position, shafts 212 and 214 are free to rotate.

When ends 250 of pawl 220 are disengaged from notches 248, assembly 24 can be made to leave the open position and assume a ratcheting position by rotating handle 202 in the direction shown by arrow 222. When assembly 24 is in a ratcheting position, cam 252 does not engage pawl 218, the ends of pawl 218 engage the stops 264 of a pair of teeth 238 to prevent wheels 236 from rotating in the direction shown by arrow 222, and ends 250 can engage teeth 238.

Belt 254 is secured to both frame 200 and handle 202. End 256 of belt 254 is secured to frame 200 by wrapping it around a bolt 258 that is mounted to the sides of frame 200 through openings formed in those sides, and then secured in any suitable fashion, for example by sewing, to surface 260 of belt 254. Similarly, the remaining end of belt 254 is secured to handle 202 by inserting the end from beneath (relative to the orientation of FIG. 15) assembly 24 between shafts 212 and 214, looping the end over shaft 212, and securing the end to the belt. Accordingly, the belt end is secured to shaft 212.

Handle 202 of ratchet tie down 24 is used to fix the position of belt 254 to maintain the desired force exerted on the tree trunk by belt 254. Assembly 24 is bolted to top end 66 of angle 20 with bolts 68 and 70. Belt 254 is tightened by moving assembly 24 from its ratcheting position and cranking handle 202 to wrap belt 254 around shafts 212 and 214. Specifically, pawl 220 is slid against the force of spring 234 away from notches 248 until its ends are disengaged from notches 248 and handle 202 is rotated in the direction shown by arrow 222, with the ends of pawl 218 and ends 250 of pawl 220 riding along ramps 262 of teeth 238 against the force of springs 246 and 234, respectively. Handle 202 is rotated in direction 222 until one of several ratcheting positions is reached, in which ends 250 engage a stop section 264 of a pair of teeth 238, the exact position chosen depending on how far the user rotated handle 202 and which teeth 238 are engaged by ends 250 of pawl 220. This action also rotates cam 252 until it no longer prevents the ends of pawl 218 from making contact with teeth 238. Handle 202 is rotated in the direction shown by arrow 224, causing ends 250 of pawl 220 to push against stops 264 of the teeth 238 with which they are engaged to rotate shafts 212 and 214 in the direction shown by arrow 224 and wrap a segment of belt 254 around shafts 212 and 214. The ends of pawl 218 abut stops 264 to prevent rotation of shafts 212 and 214 in direction 222. The process of cranking handle 202 by rotating it first in direction 222 to engage a pair of teeth 238 and then rotating handle 202 in direction 224 to wrap another segment of belt 254 around shafts 212 and 214 is repeated until a sufficient segment of belt 254 has been wrapped around shafts 212 and 214 to tighten belt 254 to the desired degree. The ends of pawl 218 engage the stops 264 of a pair of teeth 238 to prevent subsequent loosening of the belt by rotation of shafts 212 and 214 in direction 222.

Belt 254 is loosened by moving assembly 24 to its open position to free shafts 212 and 214 for rotation in direction 222, and pulling downward (relative to the orientation of FIG. 15) on belt 254 to cause it to unwrap from shafts 212 and 214 by rotating them in direction 222. Specifically, pawl 220 is slid against the force of spring 234 away from wheels 236 until ends 250 of pawl 220 become disengaged from teeth 238. Handle 202 is rotated in direction 224 until the open position is reached, in which ends 250 are located in notches 248 and cam 252 has pushed the ends of pawl 218 out of engagement with teeth 238. Belt 254 then can be pulled to move shafts 212 and 214 in direction 222 and unwrap belt 254 from them.

The easiest way to mount a cut tree to stand 10 is to position the tree on it side on the supporting surface, to mount stand 10 to the tree trunk, and then to pull the tree and stand, as a unit, upright. After positioning the tree on its side, the belt of assembly 24 is looped around the trunk. The lever of assembly 24 is cranked as described above until the belt is tightened sufficiently around the trunk to prevent stand 10 from becoming disengaged from the trunk. Then, vertical support 18 is so positioned that spiked bolt 55 can be hammered or otherwise driven into the bottom of the tree trunk through slot 54. At this point, the belt can be tightened completely, and the tree and stand can be righted. The belt can be adjusted on the trunk somewhat to make minor adjustments to the inclination of the tree. Additional inclination adjustment can be achieved by adjusting levellers 94.

FIGS. 8 through 14 show tree stand 110, which constitutes an alternate embodiment of the present invention. The functions of stand 110 are similar to those of stand 10, except that stand 110 does not accommodate the range of trunk diameters that stand 10 can accommodate, and stand 110 affords a greater degree of adjustment to tree inclination than is provided by stand 10.

The construction of stand 110 also is similar to that of stand 10. U-bolt 124, rather than ratchet tie down 24, holds the tree trunk against a stabilizer angle 120. U-bolt 124 does not accommodate the range of tree trunk diameters that assembly 24 can accommodate due to the substantially fixed distance between ends 126 and 128 of bolt 124. Offset plate 130 replaces member 30 of stand 10, and defines three areas, upper flange 190, intermediate section 184, and bottom flange 142. Plate 130, unlike member 30, does not directly contribute to the stabilization of stand 110 on the supporting surface. Unlike member 30, flange 190 of plate 130 defines an oval opening or slot 160, which permits adjustment to the inclination of angle 120 (and, therefore, the inclination of the tree held by stand 110) relative to the supporting surface, and a pair of holes 186 and 188 that are positioned to receive the ends 126 and 128 of U-bolt 124. Flange 142 of plate 130 defines holes 146 that are positioned for alignment with holes 52 of leg units 16.

Leg units 16 for stand 110 are identical to leg units 16 of stand 10, with the exception that they do not include levellers 94. The entire undersurface of each leg 26, therefore, engages the supporting surface during use of stand 110. Leg units 16 are mounted to plate 130 with a pair of bolts 168 and 169. Bottom flange 142 of plate 130 defines a pair of holes 146 that are positioned to permit alignment of holes 146 with holes 52 of units 16.

Angle 120 is identical to angle 20, with the exception of the position of holes 196 and 198, which, in the case of angle 120, are formed along crease or fold 194 defined by angle 120. The positioning of holes 196 and 198 should be chosen to facilitate their alignment with hole 192 and slot 160 formed in flange 190 of plate 130, and to provide a separation of about one inch between the bottom of support 118 (which is identical to support 18 of stand 10) and the bottom of pan P when the pan is in place. The bottom end 158 of angle 120 is welded to the upper surface 156 of vertical support 118.

Two leg units 16 are mounted to plate 130 by first placing surface 76 of a first leg unit 16 against plate 132 and aligning holes 52 of unit 16 with holes 133 formed in plate 132. Bolts 168 and 169 are inserted through holes 52 of the first unit 16 and holes 133 of plate 132. Surface 77 of the first unit 16 is placed into contact with surface 77 of the second unit 16 by inserting bolts 168 and 169 through holes 52 of the second unit 16. Surface 76 of the second unit 16 is placed into contact with surface 182 of flange 142, by inserting bolts 168 and 169 through holes 146 of plate 130. Nuts 166 and 167 are threaded onto the ends of bolts 168 and 169, respectively, and tightened against flange 142.

Angle 120 and vertical support 118 are mounted to plate 130 by placing corner 194 into contact with surface 178 of flange 190 of plate 130, and aligning holes 198 and 196 of angle 120 with hole 192 and slot 160 of flange 190. Bolts 170 and 171 are inserted through holes 196, 198, and 192, and slot 160 from the direction of angle 120. Threaded knob 164 and nut 165 are threaded onto the ends of bolts 170 and 171, respectively. Knob 164 facilitates adjustment of the position of bolt 170 within slot 160 during the tree inclination adjustment process. Flange 190 of plate 130 defines a pair of holes 186 and 188, which are positioned to receive ends 126 and 128 of U-bolt 124. Threaded hand knobs 127 and 129 can be threaded onto ends 126 and 128, respectively, of U-bolt 124 to secure U-bolt 124 to plate 130.

The method for mounting a tree to stand 110 is, generally, the same as the method for mounting a tree to stand 10. Nut 53 is loosened enough to permit spiked bolt 55 to slide within slot 54, but not enough to make the assembly "sloppy." The tree is laid on its side, and vertical support 118 is secured to the bottom of the tree trunk by hammering spiked bolt 55 into the bottom of the trunk through slot 54. With the trunk resting against angle 120, ends 126 and 128 of U-bolt 124 are inserted through holes 186 and 188 of flange 190, with an end 126 and 128 on either side of the trunk, until bend 176 of U-bolt 124 comes into contact with the trunk. Hand knobs 127 and 129 are threaded onto ends 126 and 128 and tightened until the trunk is securely held against angle 120. The tree and stand 110 can then be righted as a unit. The tree trunk can be moved toward or away from angle 120 until the desired position of the trunk is reached, and nut 53 is then tightened to fix the position of the trunk on support 118.

The inclination of the tree can be adjusted using angle 120. Knob 164 should be loosened just enough to permit bolt 170 to slide back and forth within slot 160 as angle 120 is pivoted about bolt 171. The inclination of the tree in the plane of flange 190 can be adjusted by pivoting the tree to the desired inclination and tightening knob 164 and nut 165.

Figure 8:
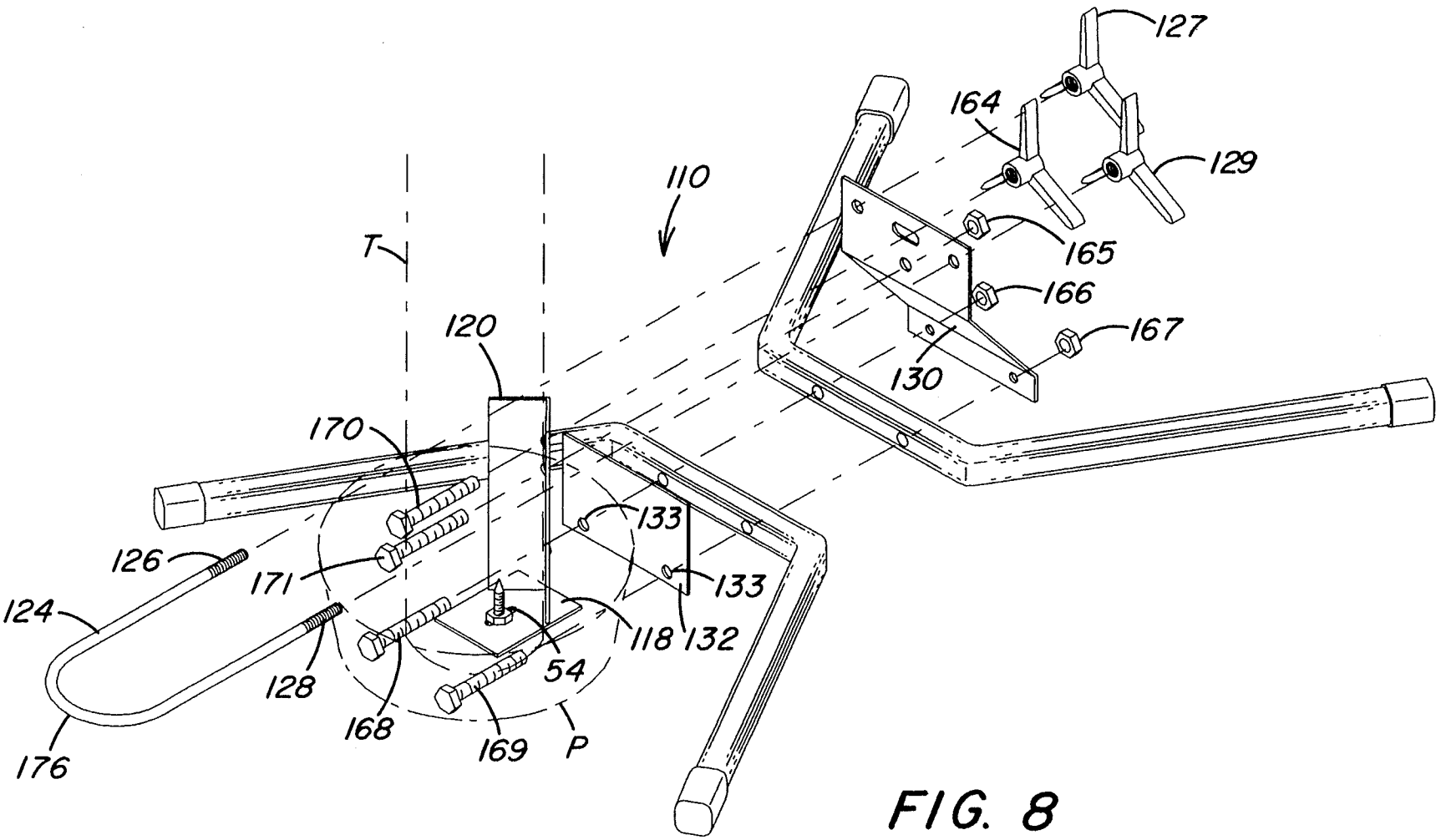
FIG. 8 is an exploded view of a stand that constitutes an alternate embodiment of the present invention.
Figure 10:
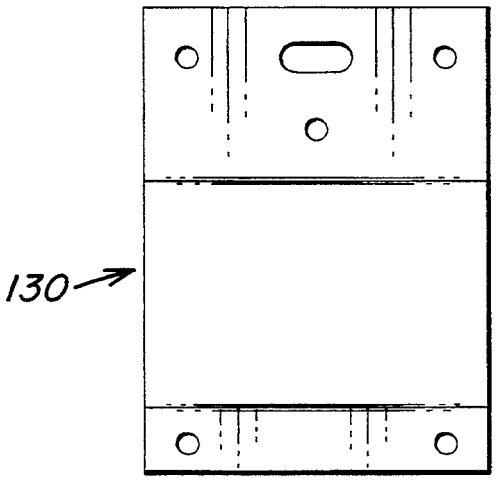
FIG. 10 is a front view of the offset plate shown in FIG. 9.
Figure 11:
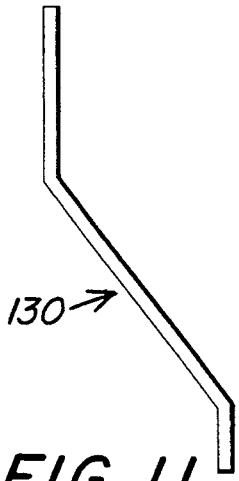
FIG. 11 is a side view of the offset plate shown in FIG. 9.
Figure 9:
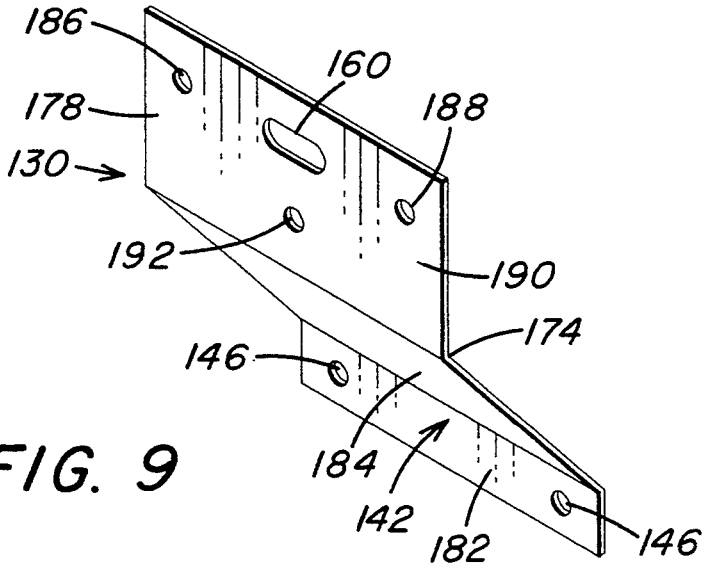
FIG. 9 is an isometric view of the offset plate of the stand shown in FIG. 8.
Figure 13:
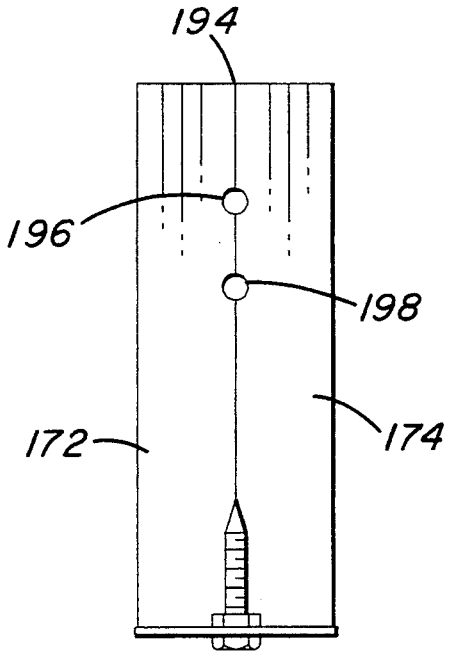
FIG. 13 is a front view of the device shown in FIG. 12.
Figure 14:
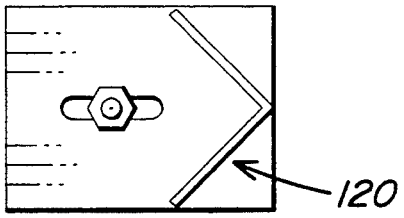
FIG. 14 is a top view of the device shown in FIG. 12.
Figure 12:
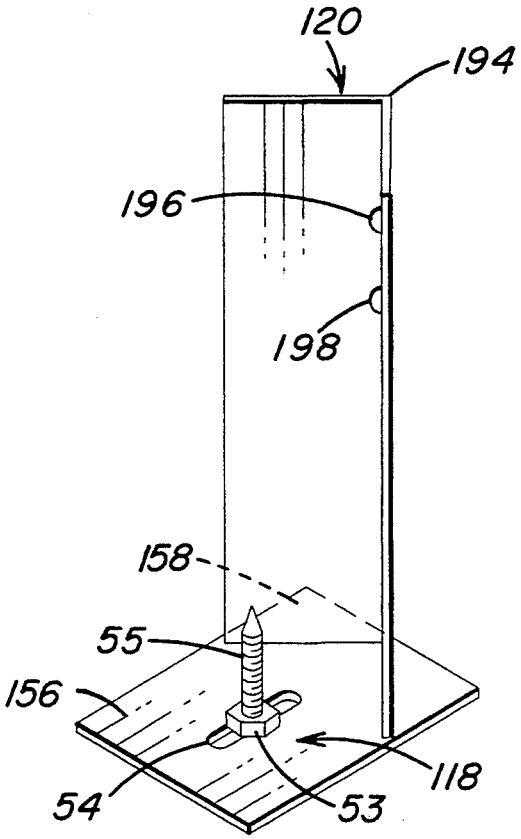
FIG. 12 is an isometric view of the vertical support and the stabilizer angle of the holder for the stand shown in FIG. 8.

The pan P shown in phantom in FIGS. 1 and 8 can be used to water a tree mounted in either of stands 10 and 110. The wall of the pan fits between vertical support 18 and the adjacent plate 32 for stand 10. Support 18 and the lower part of angle 20 (along with the lower end of the tree trunk when a tree is mounted to stand 10) are, therefore, located within the pan. The pan is filled with water and any other desired nutrients to an appropriate depth. The height of the wall of the pan must, therefore, be less than the distance between surface 80 and the supporting surface for stand 10. Similarly, the wall of the pan is located between vertical support 118 of stand 110 and plate 132. The height of the pan wall must be less than the distance between edge 174, which is formed by the junction of flange 190 and section 184, and the supporting surface for stand 110.

All metal components of stands 10 and 110, with the exception of U-bolt 124 and ratchet tie down 24, are made from any suitable low carbon steel. Of these steel pieces, all but vertical supports 18 and 118 and base unit 22 (which are formed from three-sixteenth inch steel) are formed from one-eighth inch steel. The pieces are formed by cutting the piece from stock, forming the piece using a press if necessary, and welding.

The important dimensions for stands 10 and 110 are as follows:

1. Height of each of angles 20 and 120—12 inches.
2. Width of each of flanges 82, 84, 172 and 174 of angles 20 and 120—2 inches.
3. Each of vertical supports 18 and 118—4 inches by 5.25 inches.
4. Length of each leg 26—16 inches.
5. Length of each mounting bar 28—10 inches.
6. Angle between leg 26 and bar 28—55°.

What is claimed is:

1. A tree stand for vertically supporting a tree above a horizontal surface with a trunk of the tree within an existing water pan, said tree stand comprising:

a base for supporting the stand on the surface;

a tree holder for holding the tree by the trunk;

said holder including means to adapt said holder to trees with different size trunks;

said holder including an upwardly extending element mounted on said base to extend upwardly therefrom and a depending stabilizer element secured to an upper portion of said upwardly extending element;

said upwardly extending element and said depending stabilizer element having a space therebetween;

said depending stabilizer element including a vertical support at a lower end thereof:

said vertical support being disposed above the horizontal surface; and said vertical support including means for supporting a bottom of the trunk thereon;

whereby said tree stand is for supporting the tree with said lower end of said depending stabilizer element, said vertical support, and the bottom of the trunk disposed within the existing water pan, a bottom of the existing water pan is between said vertical support and the horizontal surface and the wall of the existing water pan is disposed within said space between said upwardly extending element and said depending stabilizer element.

2. The stand recited by claim 1 wherein said base includes four legs, a first pair of said four legs are circumferentially separated for disposing the existing water pan on the surface therebetween and a second pair of said four legs are disposed at a side of said holder away from said depending stabilizer element and said vertical support.

3. The stand recited by claim 1 wherein said holder permits adjustment on the inclination of a tree held by said tree holder.

4. The stand recited by claim 1 wherein said holder includes a stabilizer member which is mounted at an upper end of said depending stabilizer element, encircles the trunk and can be adjusted to adapt said holder to trees with different size trunks by adjusting a length of said stabilizing member that encircles the trunk.

5. The stand recited by claim 4 wherein said stabilizing member includes a ratchet and belt assembly, said ratchet being used to tighten said belt around the trunk.

6. The stand recited by claim 1 wherein said holder includes a lateral support at an upper end of said depending stabilizer element for restricting lateral movement of the trunk.

7. The stand recited by claim 6 wherein said lateral support includes two members between which the trunk is held and which can be adjusted relative to each other to accommodate the trunks of different diameters and a first of said two members includes means for relatively adjusting the position thereof with respect to a second of said two members.

8. The stand recited by claim 7 wherein one said lateral support member is a U-bolt.

9. The stand recited by claim 1 wherein said vertical support is disposed for being maintained at least one inch above said surface.

10. The stand recited by claim 1 wherein the existing water pan includes the wall having a predetermined height and said depending stabilizer element is secured to said upper portion at a location above said surface at a predetermined distance therefrom which is greater than the predetermined height to allow the wall to be disposed below said location.

11. A tree stand for vertically supporting a tree above a horizontal surface with a trunk of the tree capable of being disposed within a existing water pan, said tree stand comprising:

a base for supporting said stand on the surface;

a tree holder mounted above said base for holding the tree by the trunk;

said holder including a vertical support for supporting the tree above the surface and for bearing the weight of the tree and a lateral support for restricting lateral movement of the trunk;

said lateral support including two lateral support members between which the trunk is held;

an upwardly extending element between said base and said holder with said holder being secured at an upper end of said upwardly extending element to depend downwardly therefrom; and said holder and said upwardly extending element being separated at lower ends thereof to provide a space therebetween;

whereby the existing water pan can be disposed on the surface with a bottom thereof between said vertical support and the surface and the wall of the existing water pan in said space between said upwardly extending element and said holder.

12. The stand recited by claim 11 wherein said base includes four legs, a first pair of said four legs are circumferentially separated to be capable of receiving the existing water pan on the surface therebetween and a second pair of said four legs are disposed at a side of said holder away from said vertical support.

13. The stand recited in claim 11 wherein one said lateral support member is a U-bolt which can be relatively adjusted with respect to the other said support member.

14. The stand recited by claim 11 wherein said vertical support is disposed for being maintained at least one inch above said surface.

15. The stand recited by claim 11 wherein the existing water pan includes the wall having a predetermined height and said holder is secured to said upper end at a location above said surface at a predetermined distance therefrom which is greater than the predetermined height to allow the wall to be disposed below said location.

16. A tree stand comprising:

a base for supporting said stand on a horizontal surface;

a holder for supporting a tree by a trunk thereof;

said base having a lower area and an upper area;

said base including at least three legs;

each said leg having a surface engaging section at said lower area that is adapted to engage the surface;

said holder having an upper end and a lower end;

said holder including a vertical support at said lower end and a stabilizer at said upper end to inhibit the tree from toppling from a vertical position off said vertical support;

said vertical support being adapted to extend below the trunk for bearing the weight of the tree;

said stabilizer including retaining means that encircles the trunk;

said retaining means including means for being adjustably tighten around the trunk;

said upper end of said holder being mounted to said upper area of said base to depend downwardly therefrom toward said surface; and p1 said vertical support being disposed above said surface without making contact therewith.

17. The stand recited by claim 16 wherein said surface engaging section of said each leg includes leveling means for relative adjustment of said holder with respect to vertical.

18. The stand recited by claim 16 wherein said vertical support is disposed for being maintained at least one inch above said surface.

19. The stand recited by claim 16 wherein an existing water pan includes a wall having a predetermined height and said upper end is mounted to said upper area at a location above said surface at a predetermined distance therefrom which is greater than the predetermined height to allow the wall to be disposed below said location.

* * * * *